US010143256B2

(12) United States Patent
Straus

(10) Patent No.: US 10,143,256 B2
(45) Date of Patent: Dec. 4, 2018

(54) PROTECTIVE HELMET FOR LATERAL AND DIRECT IMPACTS

(71) Applicant: AES R&D, LLC

(72) Inventor: Albert Straus, Timonium, MD (US)

(73) Assignee: AES R&D, LLC, Timonium, MD (US)

( * ) Notice: Subject to any disclaimer, the term of this patent is extended or adjusted under 35 U.S.C. 154(b) by 6 days.

(21) Appl. No.: 15/009,960

(22) Filed: Jan. 29, 2016

(65) Prior Publication Data

US 2017/0215507 A1 Aug. 3, 2017

(51) Int. Cl.
*A41D 1/14* (2006.01)
*A42B 3/06* (2006.01)
*A63B 71/10* (2006.01)

(52) U.S. Cl.
CPC ..... *A42B 3/064* (2013.01); *A63B 71/10* (2013.01)

(58) Field of Classification Search
CPC ..... A42B 3/324; A42B 3/064; A42B 3/283; A63B 71/10
USPC ..... 2/412, 422
See application file for complete search history.

(56) References Cited

U.S. PATENT DOCUMENTS

| | | | |
|---|---|---|---|
| 2,143,483 | A | 1/1939 | Iglauer |
| 2,296,335 | A | 9/1942 | Brady |
| 2,780,815 | A | 2/1957 | Newland |
| 3,128,095 | A | 4/1964 | Sharkey |
| 3,155,981 | A | 11/1964 | McKissick et al. |
| 3,174,555 | A | 3/1965 | Pitman |
| 3,186,004 | A | 6/1965 | Carlini |
| 3,242,500 | A | 3/1966 | Derr |
| 3,245,087 | A | 4/1966 | Marchello |
| 3,435,460 | A | 4/1969 | Grant |
| 3,445,860 | A | 5/1969 | Rodell |
| 3,787,893 | A | 1/1974 | Larcher |

(Continued)

FOREIGN PATENT DOCUMENTS

| | | |
|---|---|---|
| DE | 2941019 | 4/1981 |
| FR | 1374284 | 10/1964 |

(Continued)

OTHER PUBLICATIONS

Sport techie website, Dated Dec. 2, 2015 "Building a Safer Helmet for Youth Football" http://www.sporttechie.com/2015/12/02/football-helmet-specifically-designed-protection-young-athletes/.

(Continued)

*Primary Examiner* — Timothy K Trieu
(74) *Attorney, Agent, or Firm* — Kenneth C. Spafford

(57) ABSTRACT

Apparatus for protecting a user from impacts to the head. The apparatus includes a shell configured to receive a human head and a plurality of structures attached to the outer surface of the shell, where each structure is independently coupled to the shell with a respective assembly. The structures move independently of one another but are restricted to moving laterally along the outer surface of the shell. The structures each include a foam cell that reduces the magnitude of a head-on impact as the impact transfers from the foam cell to the shell. The assemblies each include an elastomeric donut that reduces the magnitude of a lateral impact as the impact is transferred from the foam cell to the donut assembly to the shell. Thus, a user is protected from the concussive effects of a head-on impact and the rotational acceleration injuries of a lateral impact.

14 Claims, 5 Drawing Sheets

(56) References Cited

U.S. PATENT DOCUMENTS

| | | | | |
|---|---|---|---|---|
| 3,815,152 | A | 6/1974 | Bednarczuk et al. | |
| 3,818,508 | A | 6/1974 | Lammers et al. | |
| 3,859,666 | A | 1/1975 | Marietta et al. | |
| 3,992,722 | A | 11/1976 | Rhee | |
| 4,044,399 | A | 8/1977 | Morton | |
| 4,106,124 | A | 8/1978 | Green | |
| 4,223,409 | A | 9/1980 | Lee | |
| 4,307,471 | A | 12/1981 | Lovell | |
| 4,599,752 | A | 7/1986 | Mitchell | |
| 4,660,230 | A | 4/1987 | Mayling | |
| 4,692,947 | A | 9/1987 | Black et al. | |
| 4,744,107 | A * | 5/1988 | Fohl | A42B 3/227 2/422 |
| 4,937,888 | A | 7/1990 | Straus | |
| 4,996,724 | A | 3/1991 | Dextrase | |
| 5,010,598 | A | 4/1991 | Flynn et al. | |
| 5,204,998 | A * | 4/1993 | Liu | A42B 3/121 2/411 |
| 5,343,569 | A | 9/1994 | Asare et al. | |
| 5,477,565 | A | 12/1995 | Hunt, Jr. | |
| 5,519,895 | A | 5/1996 | Barnes, Jr. | |
| 5,522,091 | A | 6/1996 | Rudolf | |
| 5,633,286 | A | 5/1997 | Chen | |
| 5,724,681 | A | 3/1998 | Sykes | |
| 5,950,244 | A * | 9/1999 | Fournier | A42B 3/128 2/411 |
| 5,956,777 | A | 9/1999 | Popovich | |
| 6,065,158 | A | 5/2000 | Rush, III | |
| 6,154,889 | A | 12/2000 | Moore, III et al. | |
| 6,226,801 | B1 | 5/2001 | Alexander et al. | |
| 6,292,954 | B1 | 9/2001 | O'Bradaigh et al. | |
| 6,336,220 | B1 | 1/2002 | Sacks et al. | |
| 6,378,140 | B1 * | 4/2002 | Abraham | A42B 3/064 2/411 |
| 6,421,840 | B1 * | 7/2002 | Chen | A42B 3/06 2/172 |
| 7,089,602 | B2 | 8/2006 | Talluri | |
| 7,096,512 | B2 | 8/2006 | Blair | |
| 7,328,462 | B1 | 2/2008 | Straus | |
| 7,930,771 | B2 | 4/2011 | Depreitere et al. | |
| 8,756,719 | B2 * | 6/2014 | Veazie | A42B 3/121 2/411 |
| 8,776,272 | B1 | 7/2014 | Straus et al. | |
| 8,826,468 | B2 * | 9/2014 | Harris | A42B 3/127 2/411 |
| 8,927,088 | B2 | 1/2015 | Faden et al. | |
| 8,955,169 | B2 * | 2/2015 | Weber | A42B 3/125 2/410 |
| 9,032,558 | B2 | 5/2015 | Leon | |
| 9,060,561 | B2 | 6/2015 | Knight | |
| 9,072,330 | B2 | 7/2015 | Yoon | |
| 9,089,180 | B2 * | 7/2015 | Phipps | A42B 3/12 |
| 2002/0152541 | A1 | 10/2002 | Halstead et al. | |
| 2012/0017358 | A1 | 1/2012 | Princip et al. | |
| 2013/0019385 | A1 | 1/2013 | Knight | |
| 2013/0031700 | A1 * | 2/2013 | Wacter | A42B 3/322 2/411 |
| 2013/0247284 | A1 | 9/2013 | Hoshizaki et al. | |
| 2013/0254978 | A1 | 10/2013 | McInnis et al. | |
| 2014/0000012 | A1 | 1/2014 | Mustapha | |
| 2014/0013492 | A1 | 1/2014 | Bottlang et al. | |
| 2014/0068841 | A1 * | 3/2014 | Brown | A42B 3/122 2/413 |
| 2014/0075652 | A1 | 3/2014 | Hanson et al. | |
| 2014/0109298 | A1 | 4/2014 | Faden et al. | |
| 2014/0173810 | A1 | 6/2014 | Suddaby | |
| 2014/0208486 | A1 | 7/2014 | Krueger | |
| 2014/0215694 | A1 * | 8/2014 | Grice | A42B 3/06 2/411 |
| 2015/0033453 | A1 | 2/2015 | Pannikottu et al. | |
| 2015/0135413 | A1 | 5/2015 | Mayerovitch | |
| 2015/0164173 | A1 | 6/2015 | West | |
| 2015/0223547 | A1 | 8/2015 | Wibby | |
| 2015/0237946 | A1 | 8/2015 | Simpson | |

FOREIGN PATENT DOCUMENTS

| | | |
|---|---|---|
| FR | 2566632 | 1/1986 |
| WO | WO2011121079 | 10/2011 |

OTHER PUBLICATIONS

Matthew Futterman, "Rethinking the Next Generation Helmet" Wall Street Journal Website Dated Dec. 24, 2015 http://www.wsj.com/articles/rethinking-the-next-generation-helmet-1450998090, written by Matthew Futterman.

Bryan Gruley and Peter Robison, "This Football Helmet Crumples—and That's Good" Bloomberg Business, Dated Jan. 11, 2016 http://www.bloomberg.com/features/2016-vicis-football-helmet/.

* cited by examiner

PROTECTIVE HELMET FOR LATERAL AND DIRECT IMPACTS

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND

1. Field of Invention

This invention pertains to protective headgear. More particularly, this invention pertains to helmets that protect against injuries from direct and lateral impacts to the head.

2. Description of the Related Art

Concussions are a common problem in American football and other contact sports. Repetitive impact to the head can lead to very serious and long term injuries and related issues. Therefore, it is important that measures be taken to protect athletes, to reduce their risks.

Various types of sports helmets are used to reduce brain injuries, including skull and neck injuries, resulting from head impacts. Such helmets typically employ a hard outer shell in combination with internal padding made of an energy-absorbing material. A conventional helmet is generally designed to prevent skull fracture, and, to some extent, injuries associated with linear acceleration following a direct impact. Bio-mechanical research has long understood, however, that angular forces from a lateral impact can cause serious brain damage, including concussion, axonal injury, and hemorrhages. Neurological research studies show that angular or rotational forces can strain nerve cells and axons more than linear forces. It is thus desirable to have protective headgear that protects against both direct impacts and lateral impacts that cause rotational injuries.

BRIEF SUMMARY

According to one embodiment of the present invention, a protective helmet is provided. The helmet includes a shell configured to receive a human head. A plurality of structures are independently coupled to the shell and are directly adjacent to the outer surface of the shell. Each structure moves independently of the other structures but is restricted to move laterally along the outer surface to the shell. When a structure is hit with an impact, the impact's magnitude is reduced as the impact is transferred from the structure to the shell.

In one embodiment, each structure can be independently replaced by manually detaching it from the shell. In one embodiment, each structure includes a cell made of foam with a specific resiliency, where an optimal resiliency is based upon field impact testing for a particular player position. In one embodiment, each structure includes both a back plate adjacent to the shell and a cell, where the back plates are farther away from each other than the cells. The cells have adjacent perimeters that are beveled at supplemental angles to one another.

In one embodiment, each structure is coupled to a respective assembly that in turn is coupled to the helmet shell. Each assembly includes an elastomeric donut whose top surface is coplanar with the outer surface of the shell. Each donut is capable of compressing and extending when its corresponding structure experiences a lateral impact. The compressing and extending of the donut extends the time of impact transfer from the structure to the shell, thereby reducing the magnitude of an impact transfer from lateral hit. In one embodiment, each assembly also includes a rectangular receiver configured to receive one or more vertical portions of a respective back plate.

In one embodiment, the donuts are elliptical and reduce the magnitude of a lateral impact a maximum amount when the impact is directly perpendicular to the donut's major axis. In one embodiment, there are vents directly between adjacent structures, thereby allowing greater freedom of lateral movement for each structure.

BRIEF DESCRIPTION OF THE SEVERAL VIEWS OF THE DRAWINGS

The above-mentioned features will become more clearly understood from the following detailed description read together with the drawings in which.

DETAILED DESCRIPTION

Apparatus 100 for protecting a user from lateral and direct impacts to the head is disclosed. Various elements are described generically below and are uniquely identified when pertinent to the discussion, for example, structures 120 are generally indicated as 120 with particular embodiments and variations shown in the figures below having a suffix, for example, 120-A, 120-B, 120-C.

Figure 1:
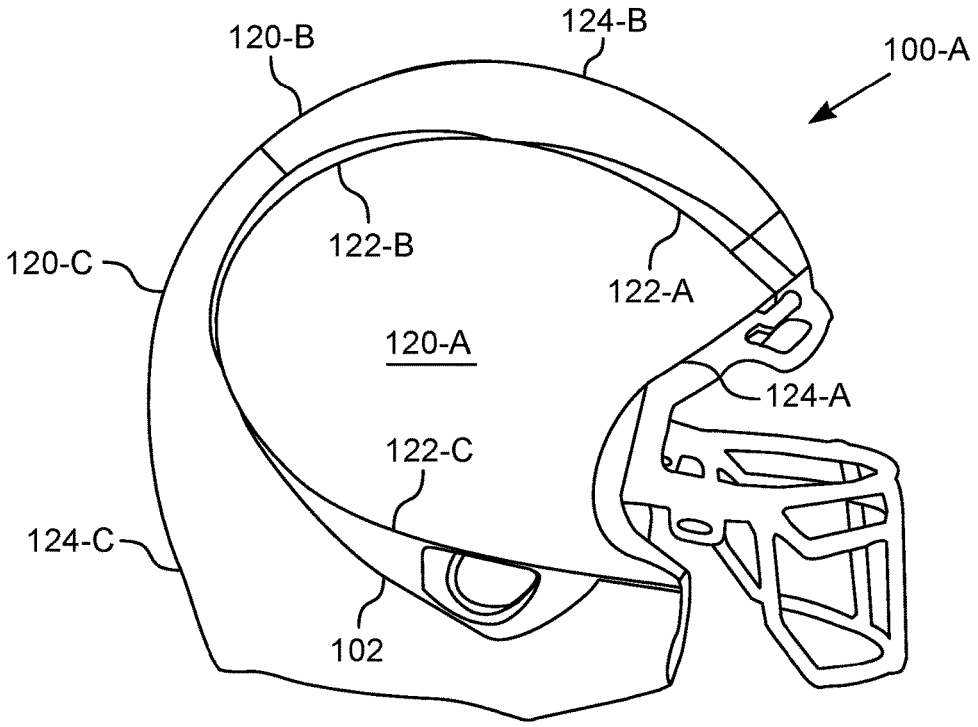
FIG. 1 is a side view of a first embodiment of a protective helmet.

FIG. 1 illustrates a perspective view of one embodiment of the protective helmet 100-A. The helmet 100-A includes a frame 102 configured to fit a human head. The helmet 100-A also includes a plurality of structures 120 that are independently attached to the outside of the frame 102, including a side structure 120-A, a top structure 102-B, and a rear structure 120-C. Each structure 120 is attached to frame 102 in a manner that permits only lateral, i.e., rotational, movement of that structure 120 along and around the frame 102. Each structure 120 is configured to move independently of the other structures 120. The external portion of each structure 120-A, 120-B, 120-C includes a respective cell 124-A, 124-B, 124-C. Cells 124 are made from a reaction-molded polyurethane flexible foam.

A lateral impact upon a structure 120 will cause the structure 120 to rotate laterally relative to the frame 102-A and increase the duration of the lateral impact event. Thus, the structures 120 protect a user from the concussive effects of a lateral impact targeted at the user's head.

An impact perpendicular to the helmet 100, i.e., a direct impact upon a structure 120, will compress its respective cell 124 and increase the duration of the direct impact event. Thus, the cells 124 protect a user from concussive effects of a direct impact targeted at the user's head.

Figure 2:
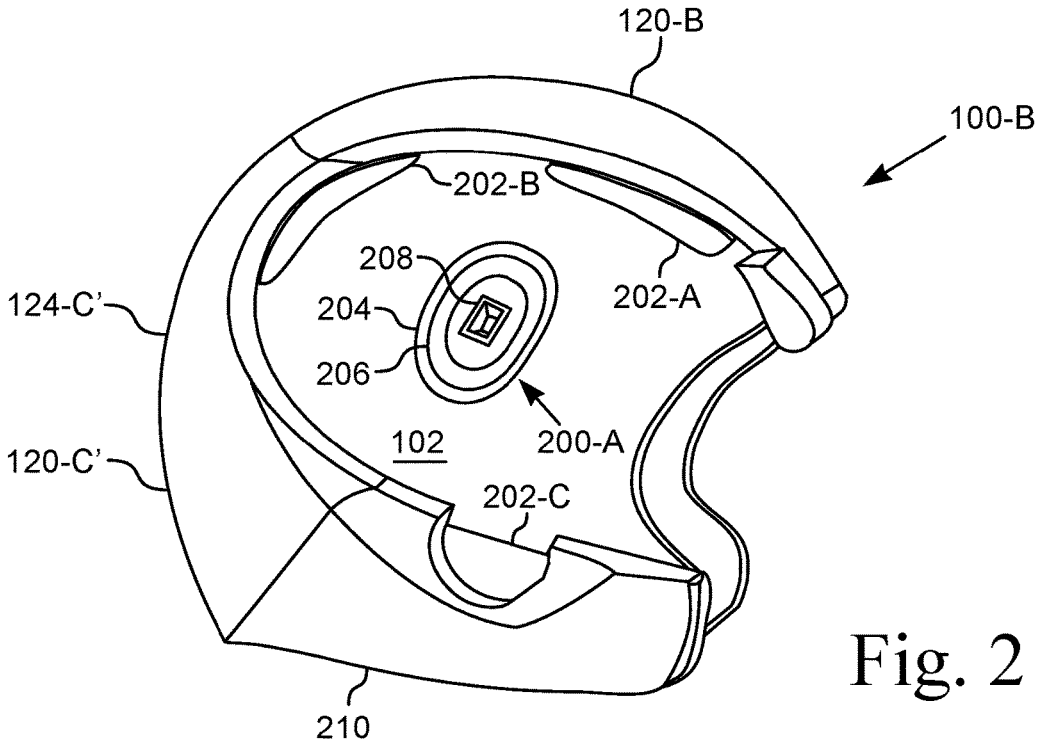
FIG. 2 is a side view of a second embodiment of a protective helmet, with one structure removed to display the helmet frame and an assembly underneath.

In other embodiments, cells 124 have a different cell density and compression force than the cells shown in FIGS. 1 and 2. The optimal cell density and compression force depends on factors including the likelihood of area of impact on a particular player. For example, a lineman may require more protection from frontal impacts and therefore top cell 124-B will require durometer adjustment after field testing. On the other hand, a quarterback may require more protection in the occipital region, and side and rear cells 124-A, 124-C will require durometer adjustment after field testing.

In this embodiment, vents 122-A, 122-B, 122-C allow for air flow to the user's head through air holes 202-A, 202-B, 202-C. Vents 122 also create spacing between structures 120 which allows structures 120 to rotate laterally along helmet without contacting other structures 120.

In other embodiments, vents 122 are in other arrangements, which are designed to create maximum spacing and minimal contact between the structures 120 during lateral movement of a structure 120. The likely direction of a structure's 120 lateral movement is based upon the likely impact vector on the helmet 100. The likely impact vector on the helmet is in turn is based upon, for example, a football player's position on a team. Thus, in other embodiments arrangements of the vents 122 and structures 120 are based upon a football player's position on the team.

In another embodiment, there are no visible vents and structures 120 completely cover the outer surface of frame 102.

FIG. 2 illustrates a helmet embodiment 100-B where portion 210 that is fixed to the outside of the frame 102 does not move relative to the frame 102. Rear structure 120-C' does not continue to the front of helmet 100-B.

In FIG. 2 structure 120-A is removed for the purpose of displaying respective assembly 200-A to which structure 120-A is affixed. Assembly 200-A includes an elastomeric donut 204 that is integral with frame 102. Assembly also includes donut hole 602 with a receiver 208 inside for receiving structure 120-A. Receiver 208 and structure 120-A are in a fixed position relative to one another. Upon a lateral impact on structure 120-A, the donut 204 deforms in a lateral direction, allowing structure 120-A and receiver 208 to move independently of frame 102 and increase the duration of the lateral impact event.

The major axis of donut 204 shown in FIG. 2 runs vertically along frame 102. A lateral impact event will be the longest where the impact vector is centered on the donut 204 and aligned along the donut 204 minor axis. Thus, the longitude of donut 204 runs perpendicular to the anticipated major vector direction of the impact. Therefore, the alignment and positioning of the donut depends upon the user's position on a team and from what lateral direction the user is most likely to experience an impact to the head. Therefore, in another embodiment, the major axis of donut 204 is aligned in another direction. In another embodiment, the donut 102 is a circle.

Figure 3:
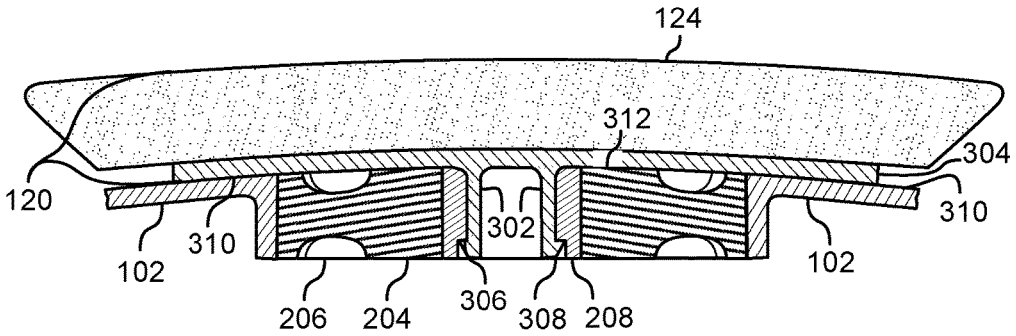
FIG. 3 is a side cross-section view of one structure and corresponding assembly of the first embodiment of FIG. 1.

FIG. 3 illustrates a cross section view of a structure 120 attached to an assembly 200, cut along the major axis 500 of donut 204. Structure 120 includes backplate 304 which is integral with cell 124. Backplate 304 includes a perpendicular section 302 configured to fit into receiver 208. Receiver 208 is rectangular in shape for precision orientation of cell 124. The perpendicular section 302 ends in barbs 308. Receiver 208 includes undercuts 306 to capture the locking edges of barbs 308. In other embodiments, the attachment mechanism between structure 120 and assembly 200 are a plurality of snap fasteners, a set of hook and loop fasteners, a tongue-in-groove pairing, a bolt and nut system, or other attachment means well-known to those with ordinary skill in the art.

Backplate 304 is contiguous with frame 102. Outer surface 310 of frame 102 is coplanar with, and shares a common tangent with, top surface 312 of donut 204 where frame outer surface 310 and donut top surface 312 are in contact. Both backplate 304 and frame 102 are made from injected-molded thermoplastic. In other embodiments, they are made from composite structures. The backplate 304 and frame 102 have a low friction modulus which allows backplate 304 and overall structure 120 to slide laterally relative to frame 102 during a lateral impact event. The low friction between backplate 304 and frame 102 allows the distortion of donut 204 to be the primary mechanism for managing the energy from the lateral impact.

However, receiver 208 and backplate 304 are locked and therefore structure 120 can only move laterally and not inward or outward, i.e., not move radially, relative to helmet frame 102.

Backplate 304 does not extend laterally as far as cell 124 in order to prevent backplate 304 from colliding into other backplates 304 during a lateral impact event. Spacing between backplates 304 allows some cell 124 deflection along the cells' perimeters when one cell 124 moves laterally into contact with another cell 124.

Donut 204 includes hollowed out volumes 206 that increases the ability of the donut 204 to extend or compress during a lateral impact event, thereby amplifying the possible lateral movement of structure 120. The configuration of these hollowed out volumes 206 can be modified to respond to a particular threat analysis where greater or lesser impact delay is required.

Figure 4:
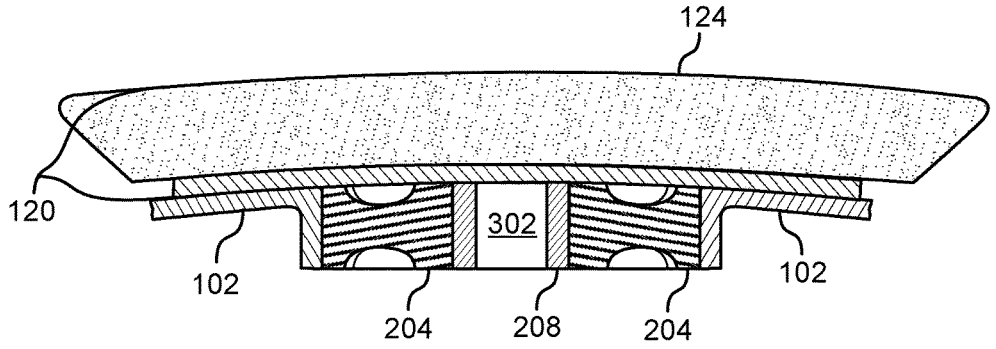
FIG. 4 is a second side-cross section view of the structure and corresponding assembly of FIG. 3, horizontally perpendicular to the cross-section view of FIG. 3.

FIG. 4 illustrates a cross section view of structure 120 attached to assembly 200, cut along the minor axis 502 of donut 204. A lateral impact event along the minor axis 502, e.g., horizontally across the structure 120 oriented in FIG. 4, creates the maximum increase in duration of the lateral impact event. Also, from the perspective orientation of FIG. 4, the vertical portions 302 of backplate 304 are perpendicular to viewable walls of receiver 208. Thus, vertical portion 302 and barbs 308 are oriented to withstand the major impact vector, i.e., they are less susceptible to bending during a lateral impact horizontal to the cell 124 in FIG. 4.

Figure 5:
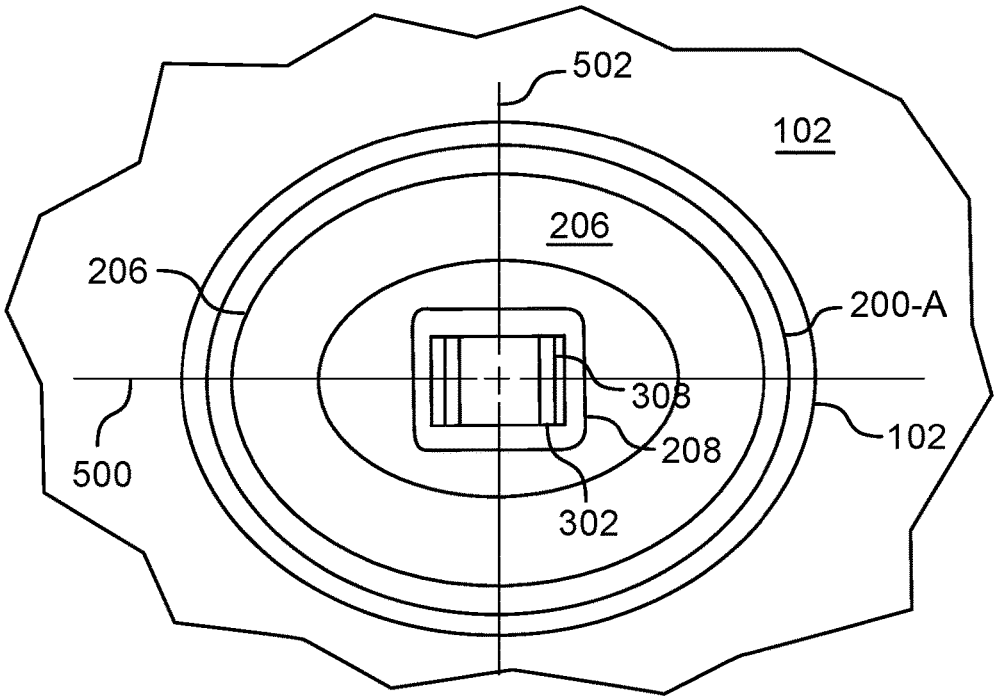
FIG. 5 is an inside view of the structure and corresponding assembly of FIGS. 3 and 4.
Figure 6:
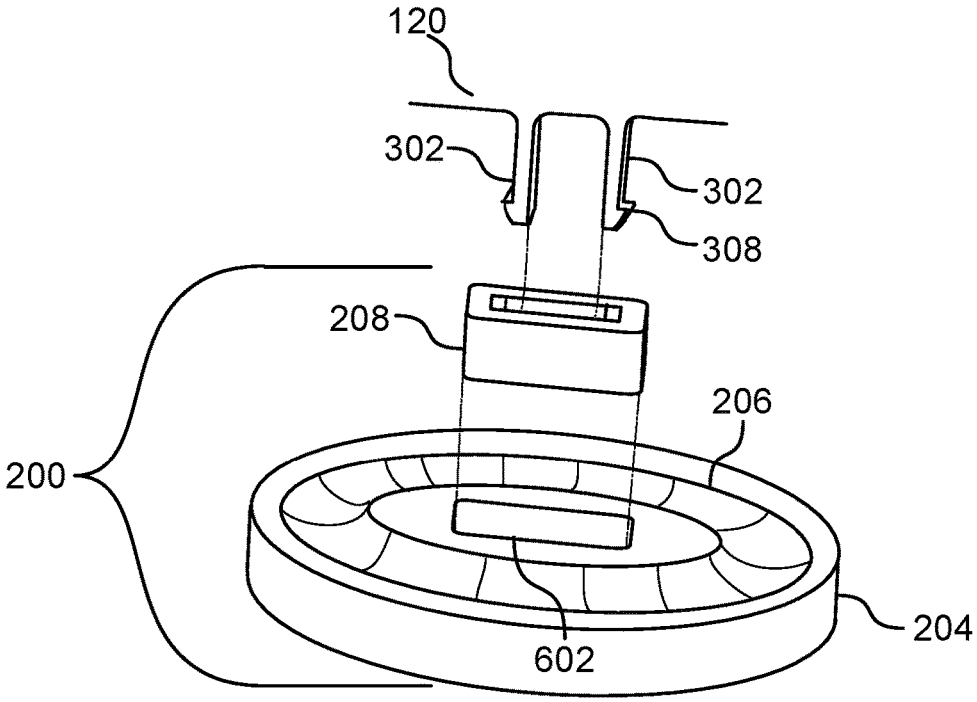
FIG. 6 is an exploded view of the structure and corresponding assembly of FIGS. 3-5.

FIG. 5 illustrates a view from inside the frame 102 of an assembly 200 attached to frame 102. FIG. 6 illustrates and exploded view of assembly 200 and the connector parts of the assembly 200 and structure 120 connector, i.e., hooks 308 and receiver 208.

FIG. 6 illustrates an exploded view displaying the assembly 200 components, namely the elastomeric donut 204 and receiver 208. Receiver 208 is inserted into hole 602 and chemically bonded to donut 204. Structure 120 can be removed from assembly 200 by pressing in barbs 308 and lifting structure 120 away from assembly 120. Thus, a user can easily replace a cell 124 that is damaged, or swap out a cell 124 for one that has different desired properties, for example higher or lower on the durometer scale.

Figure 7:
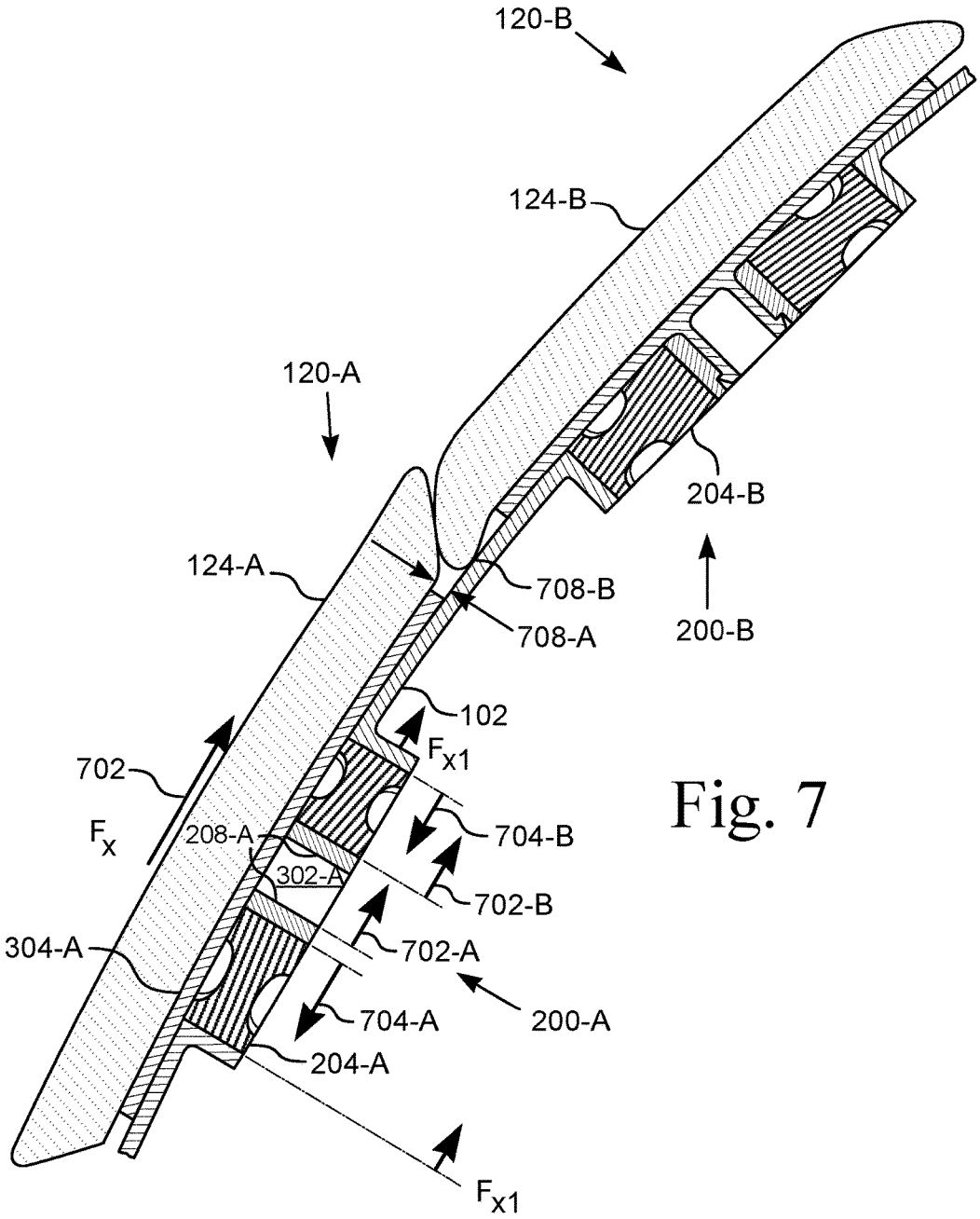
FIG. 7 is a side cross-section view of two structures and corresponding assemblies of the first embodiment of FIG. 1, where one structure is receiving a lateral impact.

FIG. 7 illustrates a rightward lateral impact event 702 on a cell 124-A. Cell 124-A, back plate 304-A, back plate vertical portion 302-A, and receiver 208-A are affixed together and move rightward laterally as one unit. Thus, lateral impact force $F_{\pi}$ 702 on the surface of cell 124-A drives receiver 208-A rightward in a clockwise direction with the same impact force 702-A and 702-B. However, impact force vector 702 does not immediately transfer to helmet frame 102, because frame 102 and receiver 208-A are coupled by elastomeric donut 204-A. Instead, the impact force 702 is spread out over time, as impact force subpart 702-A extends a portion of donut 204-A and impact force subpart 702-B compresses the opposite side of donut 204-A which in turn distributes the impact force 702 to frame vertical portion 208-A over an extended period of time, resulting in vector $F_{x1}$. After the impact event, the elastomeric property of donut 204-A pulls receiver 208-A and structure 120-A back to their original resting position with forces 704-A, 704-B.

Donut opposing forces 704-A and 704-B from donut 204-A and frame 102 pushing back on impact force 702 are in line with impact forces 702-A and 702-B. Thus, any shearing effect on donut 204-A is minimal, in contrast with a helmet that positions donut 204 or another type of damper/shock absorber/impact delay device directly between frame 102 and structure 120.

Cell 124-A has beveled edges supplementary to the beveled edges of adjacent cell 124-B, allowing the two adjacent cells 124-A, 124-B to move independently with minimal interference from one another. In FIG. 7, cell 124-A is temporarily rotated clockwise rightward in FIG. 7 from lateral impact 702. When cell 124-A shifts from the impact, cell 124-A experiences a slight distortion upward at 708-A where cell 124-A presses against and slides over adjacent cell 124-B. Note that cell 124-A and back plate 304-A are chemically bonded and integral and therefore do not separate. Adjacent cell 124-B experiences a downward distortion at 708-B to accommodate for rightward movement of adjacent cell 124-A. In other impact scenarios, the impacted cell experiences a downward distortion and an adjacent cell experiences and upward distortion, depending on relative cell edge relationship. Thus cell 124-A is able to move laterally relative to adjacent cell 124-B with minimal interference, and with minimal effect on structure 120-B. Cell 124-B and donut 204-B experience minimal impact distortion.

Figure 8:
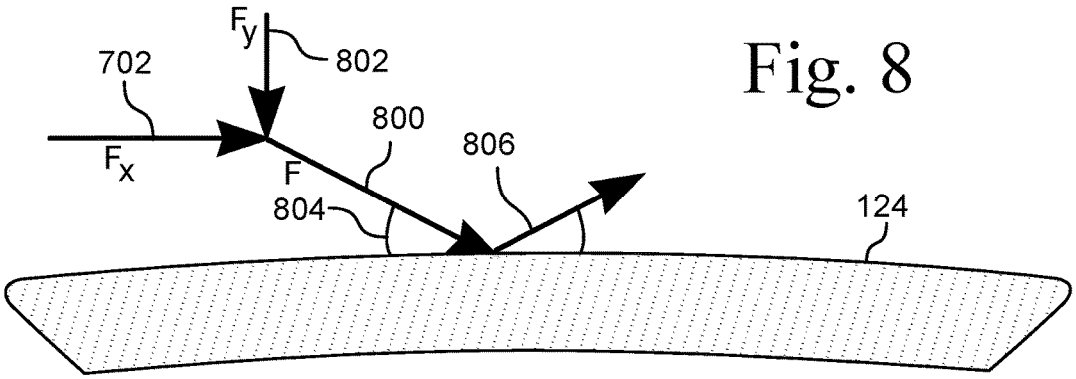
FIG. 8 is a simplified view of the structure displayed in FIG. 3.

As illustrated in FIG. 8, an impact event 800 will ordinarily occur at an angle 804 that includes lateral and direct component vectors 702, 802. The helmet 100 protects a user from the harmful effects of the impact event 800 by spreading the impact event components 702, 802 out over time. The lateral component 702 is spread out over time with the assistance of the donut assembly 204, while the direct component 802 is spread out over time with the assistance of the flexible foam cell 124.

Because of the energy-absorbing capacity of the helmet structure, impact restitution vector 806 is reduced. The diminished restitution reduces the impact on players that contact the wearer's helmet. Other players are thereby protected.

Figure 9:
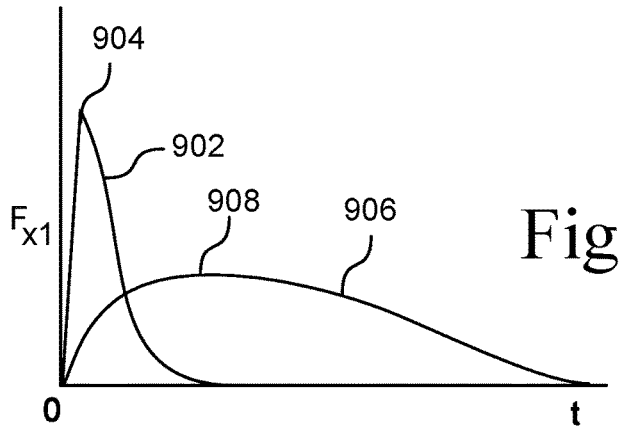
FIG. 9 is a graph displaying force over time from a lateral impact.

FIG. 9 is a line graph comparing the vector $F_{x1}$ from an impact transferred to a helmet frame 102 that is either unprotected or protected by a donut assembly 200. Line 902 represents the change of force over time dF/dt during a lateral impact event 702 on the frame of an ordinary unprotected helmet. The lateral force $F_x$ is transferred almost immediately to the frame 102, resulting in a large maximum impact 904 on the user and rotational acceleration. Line 906, on the other hand, represents the change of force over time dF/dt for embodiments of the protective helmet 100. Line 906 describes the vector $F_{x1}$ to the frame 102 as the lateral impact event 702 is transferred from the cell 124 and structure 120 to the donut 200. The donut 200 then extends/compresses while transferring the force $F_{x1}$ to the frame. Thus, a portion of the force $F_x$ is initially used to distorting the donut 200 before the force $F_{x1}$ is transferred to the frame. As a result, the force 906 on the protected helmet is spread out over time, resulting in a lower maximum impact 908 on the frame 102 and lower rotational acceleration. Thus, even though the total lateral impulse (i.e., the areas under 902 or 906) transferred upon a user is identical for a protected helmet 100 and an unprotected helmet, the maximum force 908 transferred upon a user is much less for the protective helmet 100. As a result, the maximum rotational acceleration of the user's head is reduced.

Figure 10:
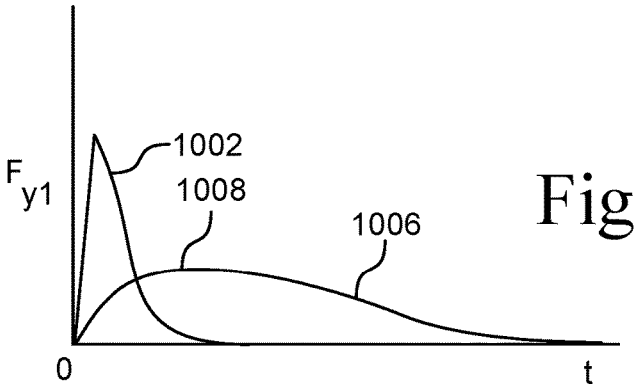
FIG. 10 is a second graph displaying force over time from a direct impact.

FIG. 10 is a line graph comparing the vector $F_{y1}$ from a direct force transferred to a helmet frame 102 that is either unprotected or protected by a cell 124. Line 1002 represents the change of force over time dF/dt during a direct impact event 802 on the frame of an ordinary unprotected helmet. The lateral force $F_y$ is transferred almost immediately to the frame 102, resulting in a large maximum impact 1004 on the user. Line 1006, on the other hand, represents the change of force over time dF/dt for embodiments of the protective helmet 100. Line 1006 describes the vector $F_{y1}$ to the frame 102 as the lateral impact event 802 is transferred onto the cell 124. Cell 124 is made of a flexible foam that will compress upon impact. Thus, cell 124 compresses while transferring the force $F_{y1}$ to the frame. Thus, a portion of the force $F_y$ is initially used to distort the cell 124 before the force $F_{y1}$ is transferred to the frame. As a result, the force 1006 on the protected helmet is spread out over time, resulting in a lower maximum impact 1008 on the frame 102. Thus, even though the total direct impulse (i.e., the areas under 1002 or 1006) transferred upon a user is identical for a protected helmet 100 and an unprotected helmet, the maximum force 1008 transferred upon a user is much less for the protective helmet 100 that is covered by cells 124.

The apparatus includes various functions.

The function of spreading out a lateral impact event over time is implemented, in one embodiment, by an external structure configured to receive the force from the lateral impact event and an assembly coupling the external structure to a helmet frame. The assembly is configured to extend or compress upon transfer of the force of the lateral impact event from the structure to the assembly.

The function of spreading out a direct impact event over time is implemented, in one embodiment, by an external structure attached to a helmet frame. The structure includes foam cells configured to compress upon receiving a direct impact.

The function of adding and removing protective cells from a helmet is implemented, in one embodiment, by a structure that includes a cell and a backplate. The backplate includes two vertical portions ending in hooks. A helmet frame includes a rectangular receiver dimensioned to receive the vertical portions and undercuts configured to capture the hooks.

The function of preventing a cell from rotating around its respective assembly is implemented, in one embodiment, by a rectangular receiver located in the assembly and a complementary shaped locking mechanism permanently coupled to the cell in a fixed position.

The function of reducing shearing stresses upon an assembly is implemented, in one embodiment, by positioning at least a portion of the assembly co-planar with the helmet frame and configuring the structure to move only in a lateral direction relative to the helmet frame.

While the present invention has been illustrated by description of embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. An apparatus for protecting a user from an impact, said apparatus comprising: a shell configured to receive a human head, said shell has an outer surface; a plurality of structures, wherein each respective structure of said plurality of structures is independently coupled to said outer surface of said shell; each said respective structure of said plurality of structures is configured to move independently of each of the other said respective structures; each said respective structure of said plurality of structures includes a respective first surface configured to slide laterally relative to said outer surface of said shell, each said respective first surface is configured to slide laterally along said outer surface of said shell, each said respective first surface is contiguous with said outer surface of said shell;

each said respective structure of said plurality of structures includes a respective cell and a respective back plate, each said respective back plate is directly between said respective cell and said shell, each said respective cell reduces the magnitude of an impact perpendicular to the user's head as the impact is transferred from said respective cell to said shell;

each said respective structure of said plurality of structures is independently coupled to said shell using a corresponding assembly;

each said corresponding assembly is configured to reduce an angular force of an external impact lateral to said apparatus as the external impact impacts the respective structure and is transferred from said respective structure to said corresponding assembly to said shell;

each said corresponding assembly includes a respective receiver for attaching said respective back plate to said corresponding assembly, said respective back plate is detachable from said corresponding assembly and re-attachable to said corresponding assembly, each said respective receiver is in a fixed position relative to said respective back plate.

2. The apparatus of claim 1, each said respective structure of said plurality of structures is mechanically connected to said shell, mechanically detachable from said shell, and mechanically re-attachable to said shell.

3. The apparatus of claim 1, each said respective cell is comprised of resilient foam material.

4. The apparatus of claim 1, wherein a shortest distance between respective back plates of any two adjacent structures of said plurality of structures is a first distance, wherein a shortest distance between respective cells of said two adjacent structures is a second distance; and said first distance is greater than said second distance.

5. The apparatus of claim 1, each corresponding assembly includes a respective elastomeric donut.

6. The apparatus of claim 5, each said respective elastomeric donut is oriented substantially parallel to said respective back plate.

7. The apparatus of claim 1, each said respective structure of said plurality of structures is configured to slide from a respective first position to a respective second position, each said respective structure biases to return to said first position.

8. An apparatus for protecting a user from an impact, said apparatus comprising:

a shell configured to receive a human head, said shell has an outer surface;

a first structure coupled to said shell, said first structure includes a first surface configured to slide laterally along said outer surface of said shell, said first surface is contiguous with said outer surface of said shell; and a first assembly coupling said first structure to said shell, said first assembly includes a first mechanism, said first mechanism biases said first structure to return to a first position;

said first mechanism of said first assembly is a first donut, said first donut includes a major axis and a minor axis, said first donut is compressible and extendable in the directions of said major axis and said minor axis;

further comprising a second structure, said second structure is coupled to said shell with a second assembly, said second structure includes a second surface configured to slide laterally along said outer surface of said shell, said first structure is directly adjacent to said second structure; said first structure includes a first cell, said second structure includes a second cell, said first and second cells are adjacent, wherein adjacent portions of said first and second cells are beveled at substantially supplementary angles to each other, wherein outer surfaces of said first and second cell adjacent portions each define an acute angle and an obtuse angle, said first cell acute angle is adjacent to said second cell obtuse angle.

9. The apparatus of claim 8, said first donut has a top surface coplanar with said outer surface of said shell.

10. The apparatus of claim 8, said first donut is an elliptical shape.

11. The apparatus of claim 8, said first structure includes a first back plate affixed to said first cell and contiguous with said outer surface of said shell, said first back plate includes said first surface;

said second structure includes a second back plate affixed to said second cell and contiguous with said outer surface of said shell, said second back plate includes said second surface said first and second back plates are spaced farther apart than said first and second cells.

12. The apparatus of claim 8, said first structure is detachable and re-attachable, said first structure is replaceable with a third structure having a third cell, said first and third cells have different resilience values.

13. The apparatus of claim 11, further including an air vent directly between said first and second back plates.

14. An apparatus for protecting a user from an impact, said apparatus comprising:

a shell configured to receive a human head, said shell has an outer surface;

a first structure coupled to said shell, said first structure includes a first surface contiguous with said outer surface of said shell, said first surface is configured to slide laterally across said outer surface of said shell;

a first assembly coupling said first structure to said shell;

said first assembly biases said first structure to a first position on said outer surface of said shell;

said first assembly including a first donut, said first donut includes a major axis and a minor axis, said first donut is compressible and extendable in the directions of said major axis and said minor axis;

further comprising a second structure, said second structure is coupled to said shell with a second assembly, said second structure includes a second surface configured to slide laterally along said outer surface of said shell, said first structure is directly adjacent to said second structure; said first structure includes a first cell, said second structure includes a second cell, said first and second cells are adjacent, wherein adjacent portions of said first and second cells are beveled at substantially supplementary angles to each other, wherein outer surfaces of said first and second cell adjacent portions each define an acute angle and an obtuse angle, said first cell acute angle is adjacent to said second cell obtuse angle.

* * * * *